US006067671A

United States Patent [19]

Ginder

[11] Patent Number: 6,067,671

[45] Date of Patent: May 30, 2000

[54] SHOWER STALL SEAT FOR DISABLED AND ELDERLY PERSONS

[76] Inventor: Karl Ginder, 6944 E. Tupper Lake Rd., Sanfield, Mich. 48890

[21] Appl. No.: 09/310,097

[22] Filed: May 12, 1999

Related U.S. Application Data

[60] Provisional application No. 60/085,246, May 13, 1998.

[51] Int. Cl.[7] ..... A47K 3/022

[52] U.S. Cl. ..... 4/578.1; 4/560.1; 4/579; 4/611

[58] Field of Search ..... 4/578.1, 579, 573.1, 4/571.1, 559, 604, 605, 611, 560.1, 254; 297/337, 241

[56] References Cited

U.S. PATENT DOCUMENTS

| | | | |
|---|---|---|---|
| 2,517,936 | 8/1950 | Spikes | 297/241 |
| 3,090,969 | 5/1963 | Maling . | |
| 3,142,513 | 7/1964 | Skokut . | |
| 3,718,365 | 2/1973 | Gibson | 4/579 |
| 4,253,203 | 3/1981 | Thomas . | |
| 4,699,425 | 10/1987 | Ohlson | 297/241 |
| 4,951,328 | 8/1990 | Potvin . | |
| 4,998,305 | 3/1991 | Davis . | |
| 5,335,970 | 8/1994 | Bryant et al. . | |
| 5,465,437 | 11/1995 | Herman . | |
| 5,467,486 | 11/1995 | Guenther . | |
| 5,903,935 | 5/1999 | Huelke | 4/578.1 |

*Primary Examiner*—Henry J. Recla
*Assistant Examiner*—Tuan Nguyen
*Attorney, Agent, or Firm*—Burns, Doane, Swecker & Mathis LLP

[57] ABSTRACT

A shower seat assembly comprising: a seat; a plurality of upstanding legs; a curved member lying in a substantially horizontal plane and supported by at least some of the legs; and the seat being pivotably supported by at least one leg and being mounted for pivotal movement along the curved member.

13 Claims, 4 Drawing Sheets

SHOWER STALL SEAT FOR DISABLED AND ELDERLY PERSONS

Claims provisional application No. 60/085,246 filed on May 13, 1998.

SUMMARY OF THE INVENTION

The present invention relates to a device for assisting an elderly person, an invalid or a disabled person to access a stall shower bath while in a sitting position. In particular, it utilizes a pivotally mounted horizontal seat moveable from a first position at the door opening of a shower stall to a second position where the seat is inside the shower stall. The seat can be locked at either the first or second positions.

BRIEF DESCRIPTION OF THE DRAWINGS

The invention will be better understood from the attached drawings in which.

DETAILED DESCRIPTION

Figure 1:
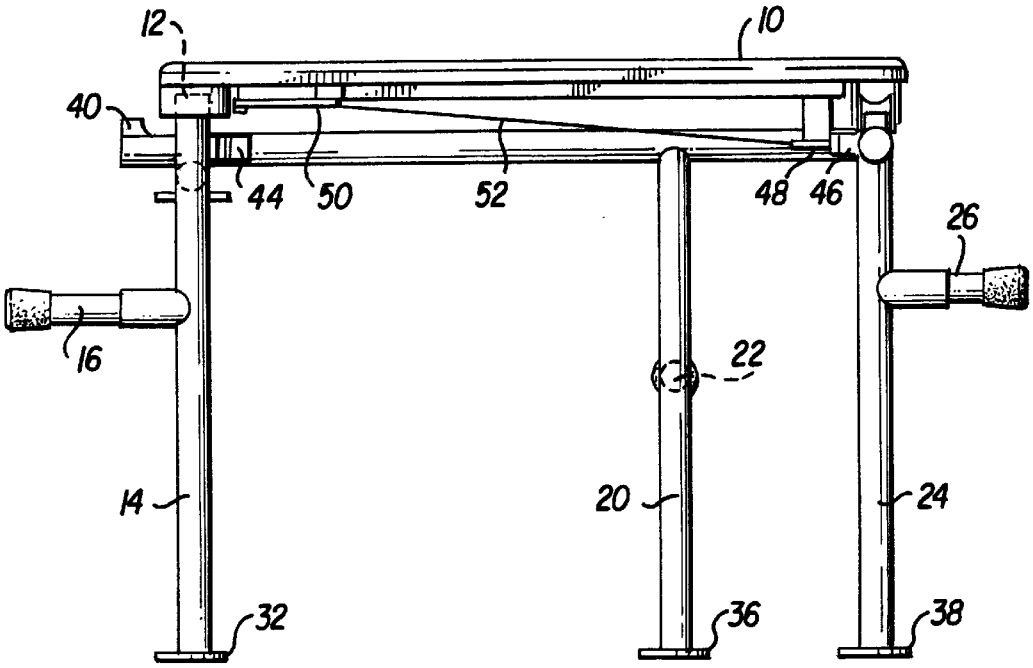
FIG. 1 is a front elevational view.
Figure 2:
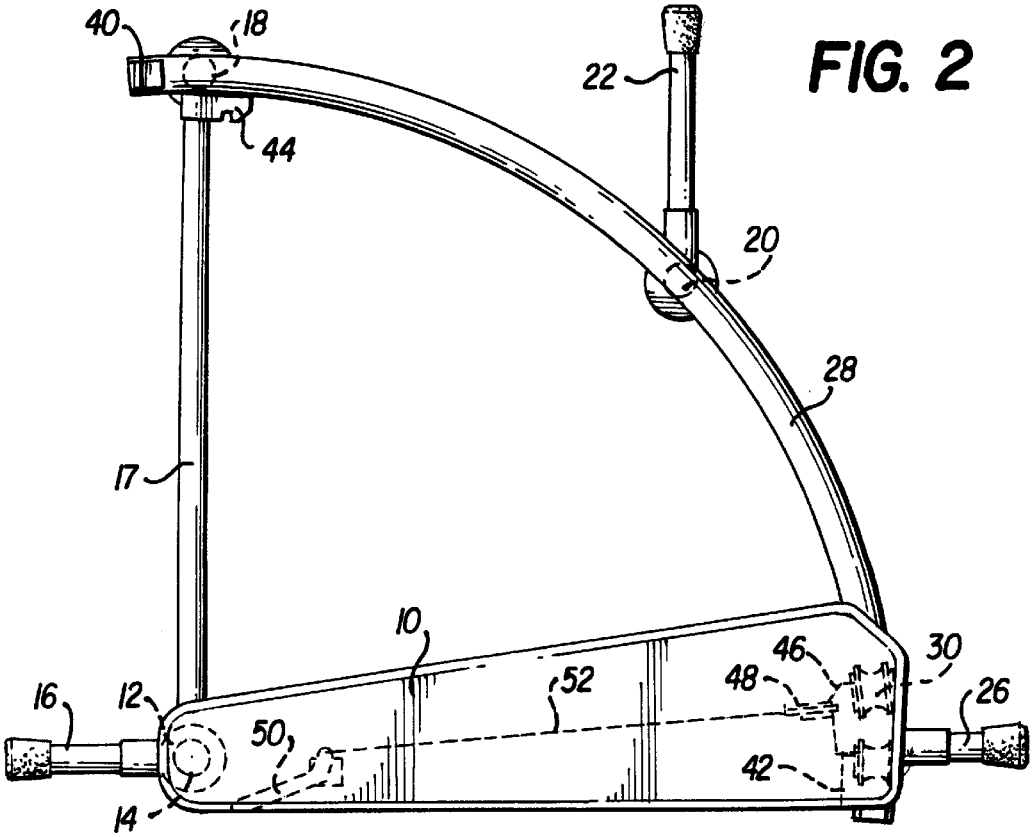
FIG. 2 is a top plan view of the device shown in FIG. 1.
Figure 3:
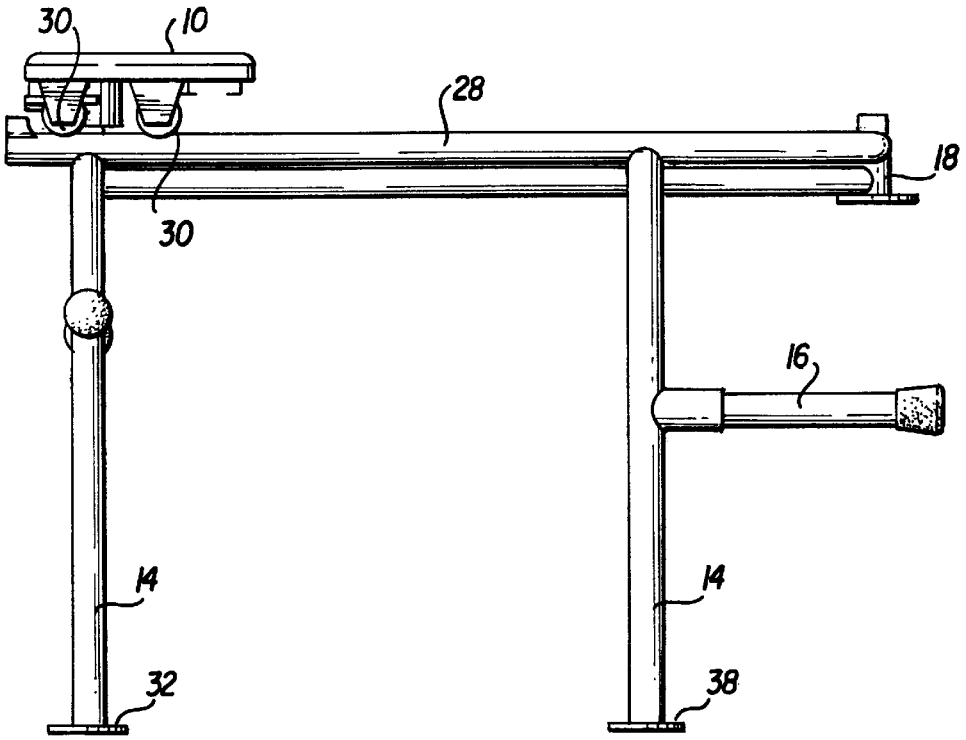
FIG. 3 is a rear view from the opposite side of FIG. 1.
Figure 4:
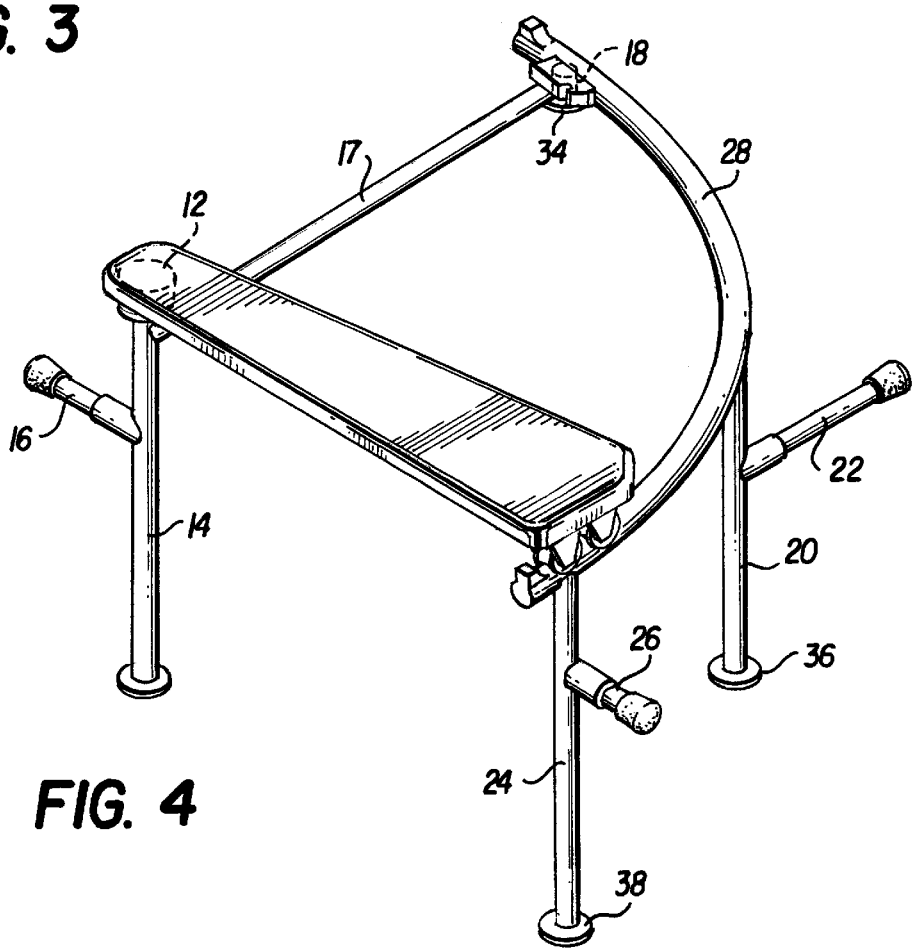
FIG. 4 is a perspective view showing the front and the right side.
Figure 5:
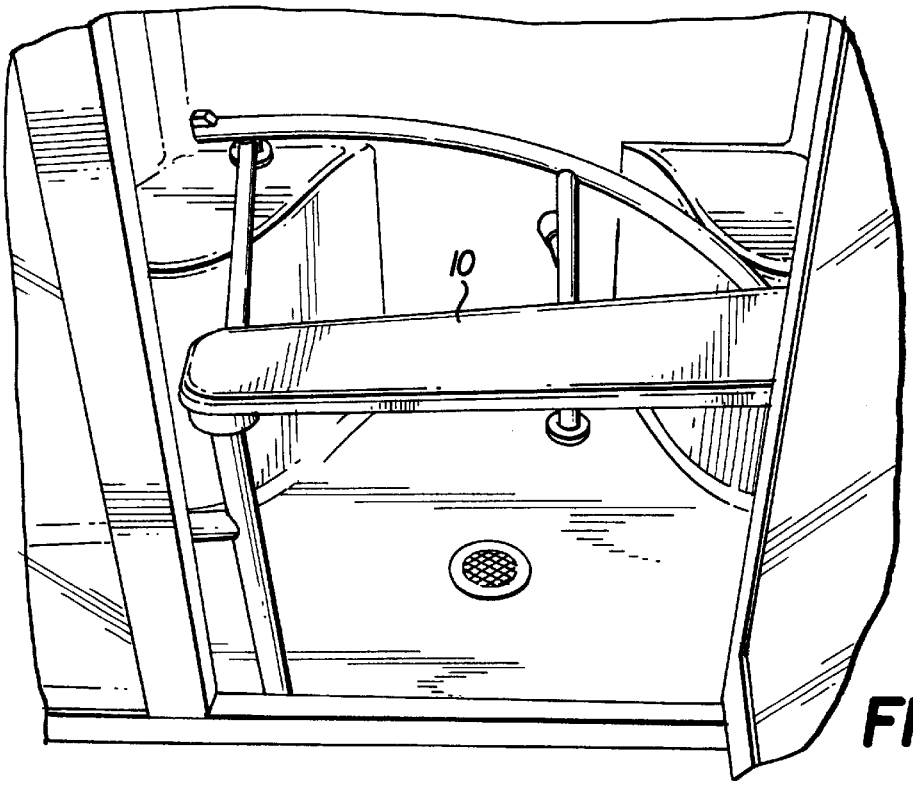
FIG. 5 is a perspective view from above and front showing the device installed in a shower stall with the seat in a first position across the door opening.
Figure 6:
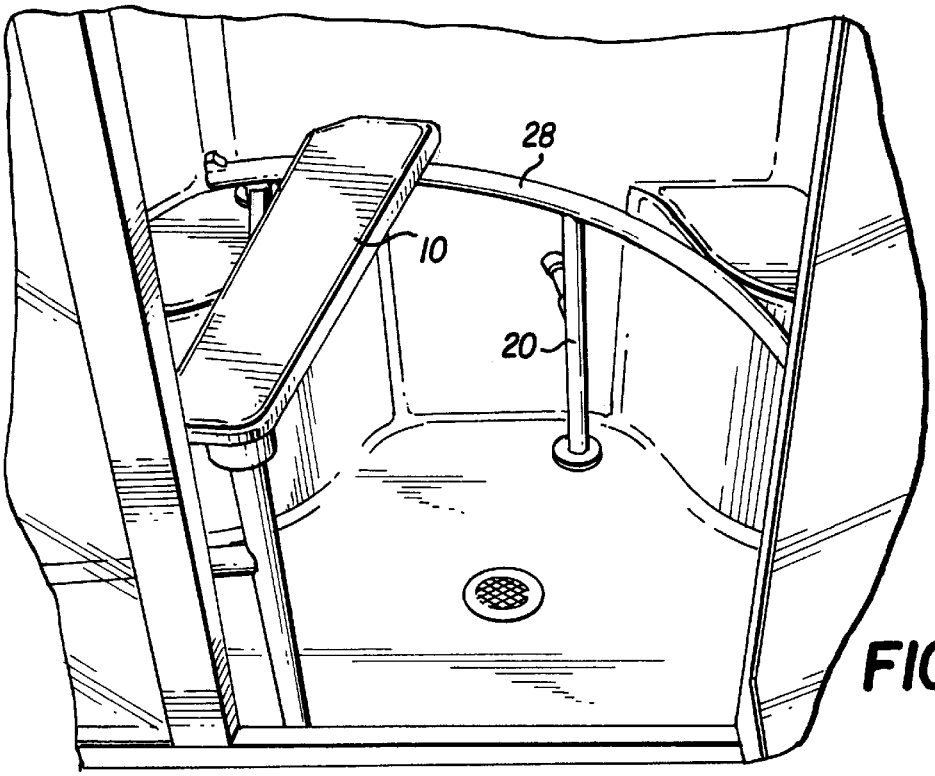
FIG. 6 is a perspective view similar to FIG. 5 but showing the seat pivoted to a second position where the seat is inside the shower stall.
Figure 8:
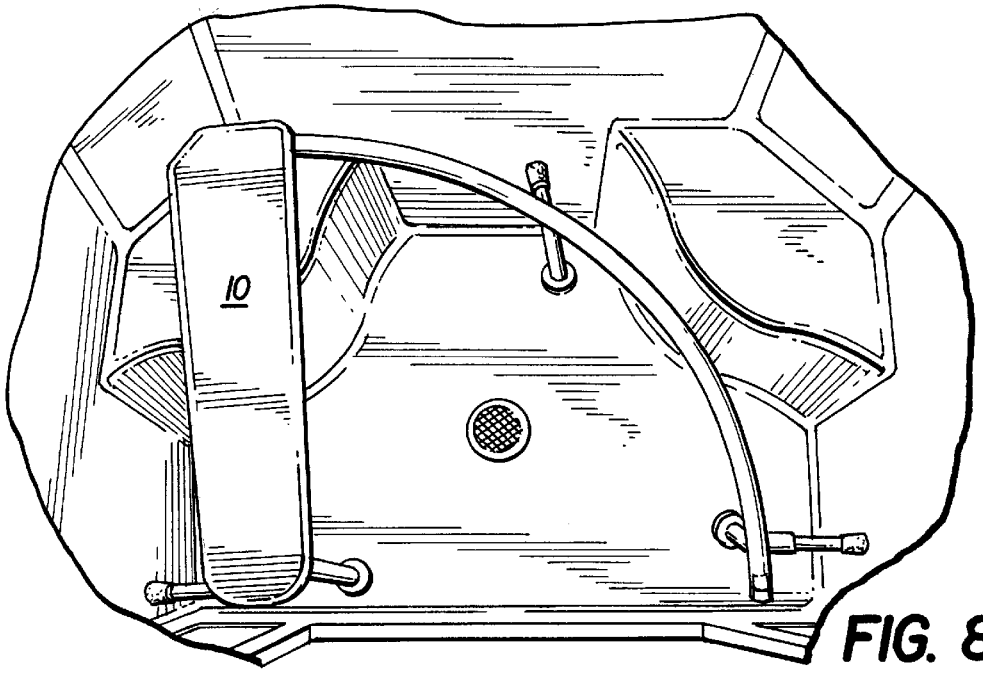
FIG. 8 is a top plan view similar to FIG. 7 but with the seat pivoted fully into the second position.

Referring to FIGS. 1 and 2, a horizontal 10 seat, is pivoted about its left end at point 12 above a leg 14. On the right end of the seat are a plurality of rollers 30 which can roll along an arcuately curved pipe 28 so the seat can be pivoted in a horizontal plane from the first position as shown in FIGS. 2, 4 and 5 to its second position as shown in FIGS. 6 and 8.

The rollers 30, preferable two or more in number, are attached to the underside of seat 10 and each roller has concave outer surface which rests on the top of arcuate pipe 28. The axis of rotation of each roller 30 lies approximately horizontally and above arcuate pipe 28, that axis of rotation lying generally on a radial line in relation to arcuate pipe 28. The concave surface of the rollers engage over the top and part of each side of arcuate pipe 28, acting to prevent relative horizontal movement between the seat 10 and the arcuate pipe 28.

The arcuate pipe 28 has a stop at each end which is engaged by rollers 30. These stops are identified by numbers 40 and 42 in FIG. 2. Adjacent each stop is a female latch member, 44 and 46, respectively. The female latch members are positioned to be locked into by a spring loaded male latch member 48 (as best seen in FIG. 1) just as rollers 30 make contact with stop 40 and 42 respectively.

The male latch 48 is operated by a lever 50 under seat 10 which is connected to latch 48 by cable 52 (see FIG. 1).

Vertical legs 14, 18, 20 and 24 support the device and each leg is preferably equipped with a foot, such as a suction cup, 32, 34, 36 or 38. Each leg optionally can be adjustable in length. Leg 18 in the shown embodiment is very short because its foot 34 is resting on a corner seat which is part of the shower stall. If there were no corner seat in the shower stall, then leg 18 would be substantially the same length as the other legs. Similarly, in the case of shower stalls having seats or protrusions in other locations, the length of any or all of the legs can be varied to accommodate the differences.

Each of the legs 14, 20 and 24 preferably has an adjustable spacing brace (respectively numbered 16, 22 and 26) which can be extended or retracted and horizontally pivoted to contact the shower stall walls to keep the device rigidly mounted in the stall. Each such brace preferably has a resilient end such as a crutch tip or cane tip to prevent marring the stall walls.

Preferably the seat is made of material not affected by water, such as rigid plastic, as shown in FIGS. 1 and 5–8. Preferably the seat loosely rests on pivot 12 and its rollers 30 loosely rest on arcuate pipe 28 so the entire seat assembly can easily be lifted off and the shower stall can be used in a conventional manner.

Figure 7:
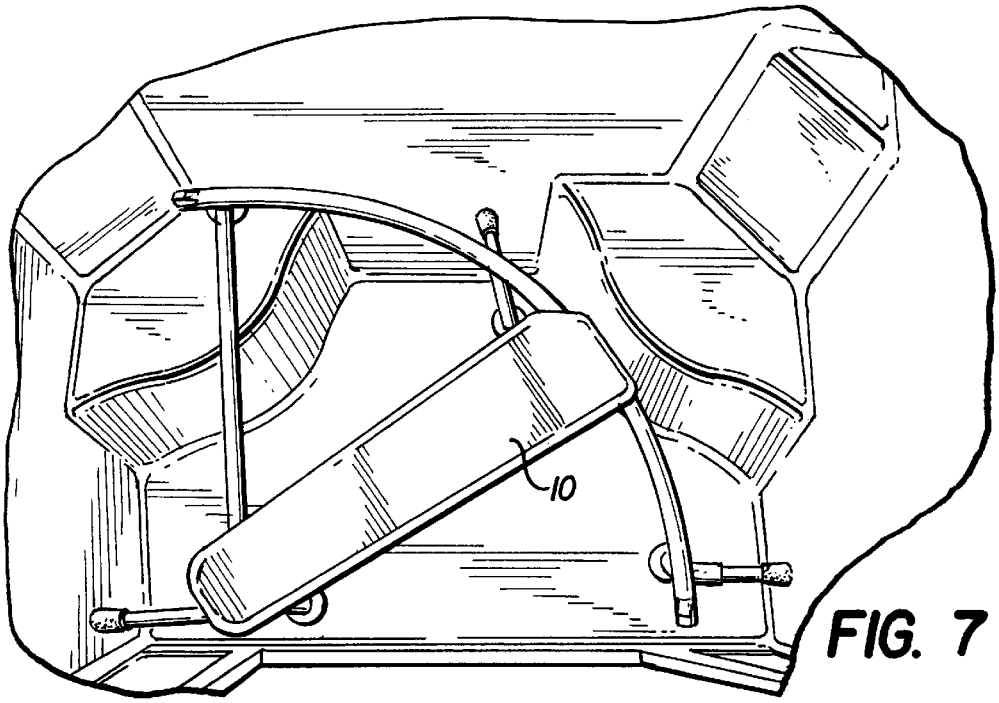
FIG. 7 is a top plan view looking down into a shower stall with the device installed and where the seat is partially pivoted toward the second position.

As best shown in FIGS. 6–8, it is preferable that there is no horizontal member extending between front legs 14 and 24 so as to provide a clear area for a user's limbs, especially legs, to swing into the shower. There is, however, preferably a horizontal brace 17 extending between legs 14 and 18.

The illustrated embodiment is intended for a shower stall having the shower head on the right side (opposite brace 17). If the shower head is on the left side, then the assembly is a mirror image where the arcuate pipe 28 is on the left side and horizontal member 17 is on the right side.

It is also contemplated that this device could be adapted for use with a shower above a bath tub. In such a case, legs 14, 24 and 18 would be very short, resting respectively on the outer and inner top edges of the tub with the arcuate pipe 28 curving across the tub with leg 20 and foot 36 resting on the tub bottom.

What is claimed is:

1. A shower seat assembly comprising:

a seat having a first end and an opposite second end;

a plurality of upstanding legs;

a curved member lying in a substantially horizontal plane and supported by at least some of said legs; and the seat being pivotably supported by at least one leg at the first end thereof and being mounted on the curved member at the second end thereof for rotational movement therealong.

2. The shower seat assembly of claim 1, wherein the seat is pivotably moveable from a first position convenient for seating of a user, to a second position convenient for use of a shower.

3. The shower seat assembly of claim 2, wherein the seat includes a releasable locking mechanism to lock the seat in the first position.

4. The shower seat assembly of claim 2, wherein the seat includes a releasable locking mechanism to lock the seat in the second position.

5. The shower seat assembly of claim 1, including at least one brace for supporting said legs.

6. The shower seat assembly of claim 5, wherein at least one of the braces extends between at least two of the legs.

7. The shower seat assembly of claim 5, wherein at least one of the braces supports the shower seat assembly against walls of a shower stall.

8. The shower seat assembly of claim 1, in which the seat has a moveable support for engaging said curved member, said support including at least one roller.

9. The shower seat assembly of claim 8, wherein the at least one roller of the moveable support is concave in cross-section and is located between the seat and the curved member.

10. The shower seat assembly of claim 1, wherein the shower seat assembly is supported by a bath tub.

11. The shower seat assembly of claim 1, wherein the seat is releasably supported by the at least one leg and the curved member so that the seat can be easily removed from the shower seat assembly.

12. A shower seat assembly comprising:

an elongate seat;

at least three upstanding legs, with a first one of said legs pivotally supporting said elongate seat at a first end of said seat;

at least one substantially horizontally extending brace connected from said first upstanding leg to a second one of said legs;

an arcuately curved member adapted to be positioned in a shower stall in a substantially horizontal plane and supported by said second leg and a third leg;

said seat being mounted on rollers at a second end of said seat for pivotal movement along the curved member, whereby said seat is movable from a first position across a shower entrance for convenient seating of a user, to a second position within the shower stall convenient for use of a shower, the rollers having outer surfaces which interfit over and roll along the curved member;

said seat being the only connection between said first and third legs to permit an open area therebetween for the limbs of a user when pivoting from said first position to said second position.

13. A shower seat assembly comprising:

a seat;

a plurality of upstanding legs, at least one leg having a length which is adjustable;

at least one brace connected to an upstanding leg for supporting the shower seat assembly against the walls of a shower stall and the at least one brace having a length which is adjustable;

a curved member lying in a substantially horizontal plane and supported by at least some of said legs; and the seat being pivotably supported by an upstanding leg at one end of said seat and being mounted on rollers at the other end of said seat for rolling movement on the curved member from a first position convenient for seating of a user outside said shower stall, to a second position convenient for use of a shower.

* * * * *